United States Patent [19]

Idenawa et al.

[11] Patent Number: 4,757,344

[45] Date of Patent: Jul. 12, 1988

[54] IMAGING APPARATUS WITH DETACHABLE CARTRIDGES

[75] Inventors: Hiroyuki Idenawa, Hiratsuka; Hideaki Mochimaru, Yokohama, both of Japan

[73] Assignee: Ricoh Company, Ltd., Tokyo, Japan

[21] Appl. No.: 885,454

[22] Filed: Jul. 14, 1986

[30] Foreign Application Priority Data

Jul. 16, 1985 [JP] Japan ..... 60-156479
Jul. 16, 1985 [JP] Japan ..... 60-156480

[51] Int. Cl.[4] ..... G03G 15/06

[52] U.S. Cl. ..... 355/3 R; 355/3 DD; 355/3 DR

[58] Field of Search ..... 355/3 R, 3 DR, 3 DD, 355/14 D

[56] References Cited

U.S. PATENT DOCUMENTS 4,530,588 7/1985 Kimura et al. ..... 355/3 R X
4,538,896 9/1985 Tayima et al. ..... 355/30 DR X
4,542,976 9/1985 Kasamura ..... 355/3 R
4,566,780 1/1986 Kajita, et al. ..... 355/3 DR X
4,585,324 4/1986 Koyama et al. ..... 355/3 R
4,634,264 1/1987 Takahashi ..... 355/3 R X

FOREIGN PATENT DOCUMENTS 60-48067 3/1985 Japan ..... 355/3 DR

*Primary Examiner*—Grimley, Arthur T.
*Assistant Examiner*—Jane K. Lau
*Attorney, Agent, or Firm*—Oblon, Fisher, Spivak, McClelland & Maier

[57] ABSTRACT

Disclosed is an electronic copier, lazer printer or like imaging apparatus for developing a latent image provided on a photoconductive element by a developing device of the type using a toner cartridge, thereby turning the latent image into a visible toner image. A body of the apparatus consists of an upper part and a lower part, the former being openably supported by the latter. A positioning frame is supported by the lower body part in such a manner as to rotatable up and down. An image carrier unit which includes at least the image carrier and a developing unit which includes at least the developing device are detachably mounted on the positioning frame and mounted to and dismounted from the frame independently of each other.

5 Claims, 4 Drawing Sheets

IMAGING APPARATUS WITH DETACHABLE CARTRIDGES

BACKGROUND OF THE INVENTION

The present invention relates to an imaging apparatus for visualizing a latent image formed on an image carrier by use of a developing device.

An imaging apparatus of the type described is well known in the art and constructed typically as a printer, facsimile apparatus and others. Also known in the art is an imaging apparatus of the kind having a body which consists of an upper part and a lower part, the upper part being openably supported by the lower part. In this kind of apparatus, an image carrier, developing unit and predetermined parts associated therewith are integrally mounted on a support member to constitute a single unit, and the single unit is detachably supported by the upper body part. In such a construction, when any of the parts included in the unit has failed, the unit may be bodily replaced with another by opening the body upper part away from the body lower part and, then, sliding the unit relative to the upper body part. This not only promotes the ease of maintenance of the apparatus but also makes it easy to remove jammed papers.

However, a problem with the prior art single unit scheme described above is that because the unit has to be replaced with the body upper part opened and held in an inclined position, the unit, too, has to be manipulated in an inclined position. This forces a person to hold himself or herself in an unnatural position throughout the maintenance work, resulting in limited operational efficiency. Another problem is that due to the sliding movement of the unit relative to the body upper part a jammed sheet is apt to be subjected to excessive forces to scratch the image carrier.

Moreover, even when only a single part in the unit, say the image carrier, has failed, the whole unit including even the developing device need be replaced, that is, even the parts in the unit which have not failed need be simply wasted.

Meanwhile, in the case where toners of different colors are selectively used, it is a common practice to prepare developing devices which are allocated one to each color of toner and selectively use the developing devices depending upon the desired color. Because the prior art single unit scheme cannot have the developing device to be replaced singly as stated above, the unit including the image carrier has to be bodily replaced every time a toner of one color is replaced with a one of another color. Hence, despite that provision of only the developing devices associated with respective colors suffices, bulky units each including an image carrier must be prepared requiring a considerable space for storage.

SUMMARY OF THE INVENTION

It is therefore an object of the present invention to provide an imaging apparatus which allows an image carrier and a developing device thereof to be attached and detached with efficiency.

It is another object of the present invention to provide a generally improved imaging apparatus.

An imaging apparatus for developing a latent image formed on an image carrier to visualize the latent image of the present invention comprises a lower housing constituting a part of a body of the apparatus, an upper housing constituting another part of the body and openably by the lower housing, a positioning frame member supported by the lower housing to be rotatable upwardly and downwardly, and an image carrier unit including at least the image carrier and a developing unit including at least a developing device, the image carrier unit and developing unit being detachably supported by the positioning frame member.

The above and other objects, features and advantage of the present invention will become more apparent from the following detailed description taken with the accompanying drawings.

DESCRIPTION OF THE PREFERRED EMBODIMENTS

Figure 1:
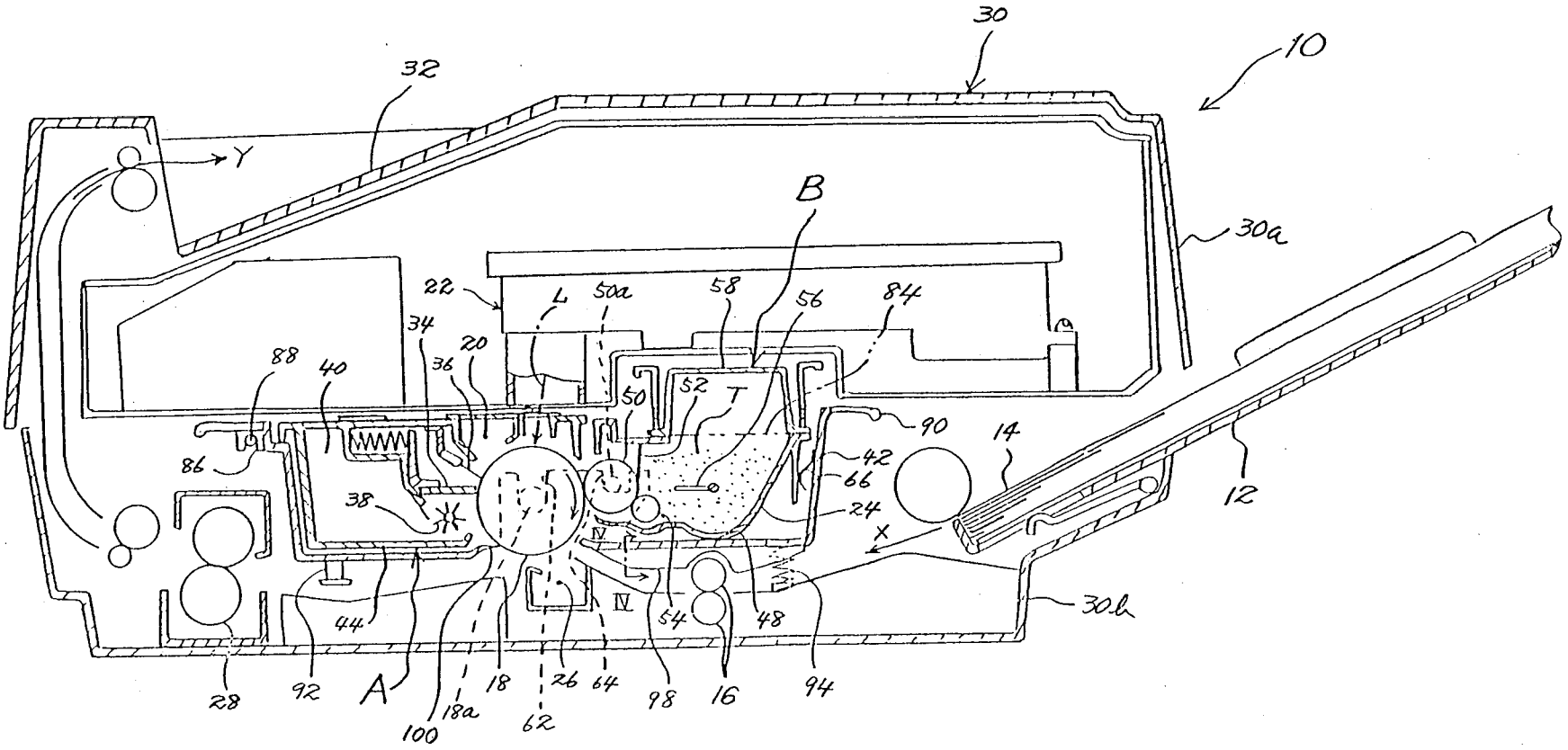
FIG. 1 is a section of a laser printer which is representative of an imaging apparatus embodying the present invention.

Referring to FIG. 1 of the drawings, a laser printer which is representative of an imaging apparatus embodying the present invention is shown and generally designated by the reference numeral 10. As shown, a recording paper 14 fed from a paper feeder 12 in a direction indicated by an arrow X is transported toward an image carrier 18 at a predetermined timing which is provided by a pair of register rollers 16. In this particular embodiment, the image carrier 18 comprises a photoconductive drum. The drum 18 which is rotated clockwise as viewed in FIG. 10 is charged by a charger 20 and, then, illuminated by a laser beam L from laser optics 22, whereby a latent image is formed electrostatically on the drum 18. As the latent image on the drum 18 reaches a developing device 24, it is visualized by a toner. The resultant toner image is transferred by a transfer charger 26 onto the paper which is transported to the drum 18. Subsequently, the paper with the toner image is fed to a fixing device 28 where the toner image is fixed. The paper come out of the device 28 is driven as indicated by an arrow Y toward a collecting section 32 which is defined by the top wall of a printer body 30. Meanwhile, the surface of the drum 18 which has released the toner image is cleaned by a cleaning device having a cleaning blade 34 so as to remove residual toner particles. Further, the drum 18 is discharged by a discharging brush 36. The toner particles removed from the drum 18 are collected in a chamber 40 by a bladed wheel 38.

The construction and operation described so far are essentially the same as those of a prior art printer. The difference is that the image carrier, or drum, 18 and parts associated therewith are constructed as a single image carrier unit A and the developing device 24 as a single developing unit B, the two units A and B being detachably supported by a positioning frame 42 independently of each other.

Figure 2:
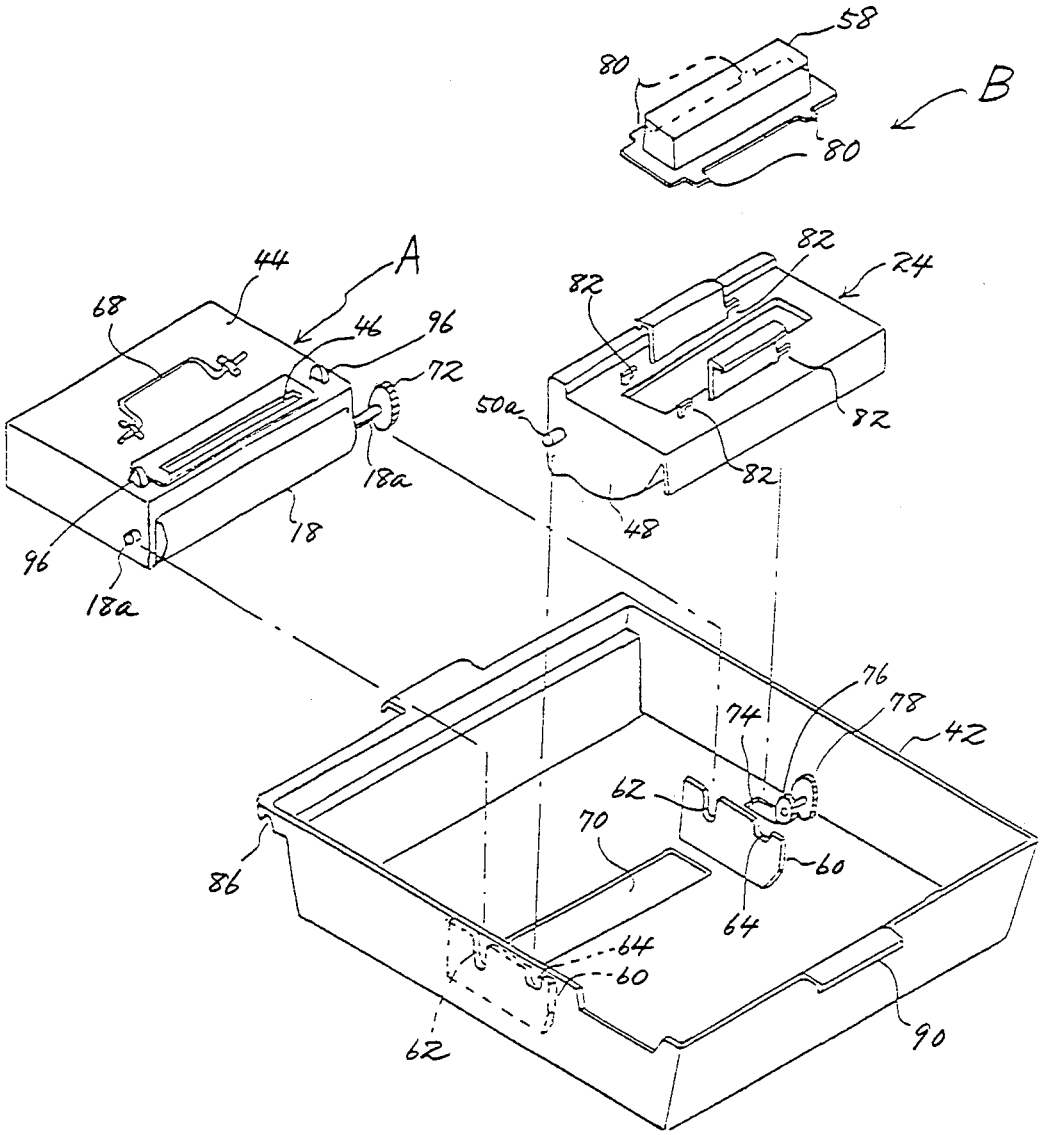
FIG. 2 is a perspective view of a developing unit and an image carrier unit of the laser printer which are removed from a positioning frame.

Specifically, as best shown in FIG. 2, the image carrier unit A includes a box-like casing 44, and a shaft 18*a* of the drum 18 which is journalled to the casing 44. The casing 44 is formed with a slot 46 through which the laser beam from the laser optics 22 enters the casing 44. The casing 44 itself defines the previously mentioned chamber 40 for toner collection. Further, the charger 20, brush 36, bladed wheel 38 and cleaning blade 34 are supported by the casing 44 to complete the image carrier unit A.

Referring again to FIG. 1, the developing device 24 comprises a reservoir 48 storing a toner T, a developing roller 50 located to face the drum 18, a blade 52 adapted to regulate the thickness of a toner layer which is formed on the roller 50, a supply roller 54 adapted to supply the toner to the roller 50, and an agitator 56 adapted to agitate the toner T in the reservoir 48. As also shown in FIG. 2, the developing roller 50 has a shaft 50*a* which is journalled to the reservoir 48. Also journalled to the reservoir 48 are the supply roller 54 and agitator 56. The blade 52 is rigidly connected at one end to the reservoir 48. A toner cartridge 58 is removably mounted on the reservoir 48. The cartridge 58 and the developing device 24 constitutes the developing unit B.

In this particular embodiment, the positioning frame 42 is provided with a box-like configuration which is open at the top and is supported by the printer body 30. The frame 42 includes a pair of positioning members 60 which are rigidly mounted on the bottom of the frame 42. The positioning members 60 are provided with a pair of notches 62 adapted to support the shaft 18*a* of the drum 18, and a pair of notches 64 adapted to support the shaft 50*a* of the developing roller 50. Specifically, the shafts 18*a* and 50*a* are respectively received in the notches 62 and 64 to accurately position the image carrier unit A and the developing unit B relative to the frame 42. In the illustrative embodiment, the notches 64 have a width which is slightly greater than the diameter of the shaft 50*a* of the developing roller 50 so that, when the shaft 50*a* is received in the notches 64, a spring 66 which is positioned between the frame 42 and the unit B urges the unit B leftwardly as viewed in FIG. 1, i.e., against one side wall of the notches 64 as shown in FIG. 1. Such an arrangement is advantageous in that where the roller 50 and the drum 18 are located to face each other with a predetermined small gap defined therebetween, the gap can be maintained uniform over the whole axial dimension of the drum 18 and, where the surface of the roller 50 is made elastically deformable and pressed against the drum 18 while being elastically deformed, the pressure exerted by the roller 50 can be maintained uniform over the whole axial dimension of the roller 50.

Figure 3:
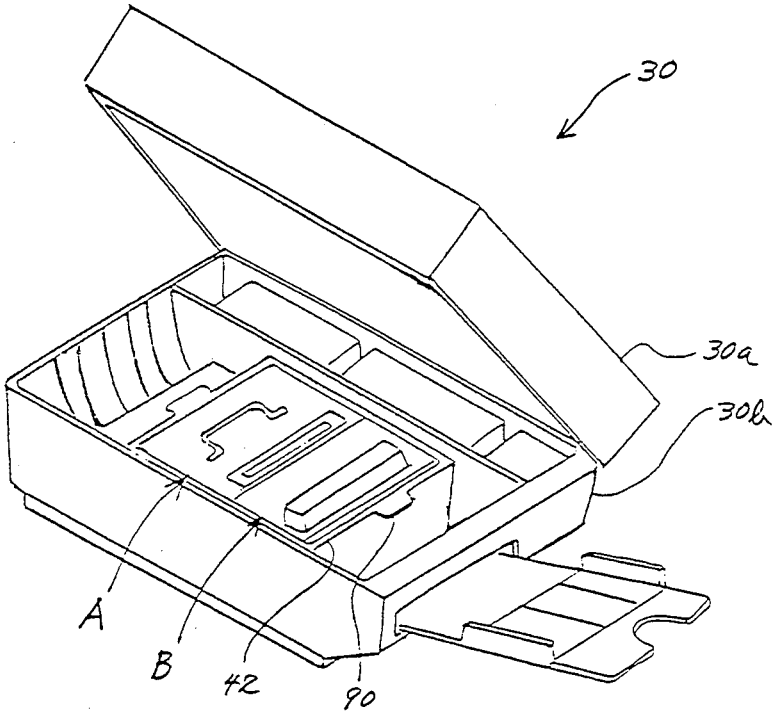
FIG. 3 is a perspective view showing a body of the laser printer with an upper part thereof opened.

As shown in FIG. 3, in this particular embodiment, the printer body 30 consists of an upper part 30*a* and a lower part 30*b*. The upper body part 30*a* is hinged to the lower body part 30*b* so as to be openable away from the latter. The image carrier unit A, developing unit B and frame 42 belong to the lower body part 30*b*. In this construction, opening the upper body part 30*a* as shown in FIG. 3 causes the tops of the units A and B to be exposed to the outside. Then, the units A and B can be readily removed from the printer body 30 by pulling them up until the shafts 18*a* and 50 become dislodged from their associated notches 62 and 64. To mount the units A and B, on the other hand, they are simply lowered until the shafts 18*a* and 50*a* become lodged in the notches 62 and 42, respectively. In this instance, because the bottom 30*b* of the printer body 30 and the positioning frame 42 are each held in a horizontal position, a person is allowed to mount and dismount the units A and B in an easy position. Should the units A and B be received in the upper body part 30*a*, as has been the case with the prior art apparatus, the upper body part 30*a* would be inclined when opened forcing a person to manipulate the units A and B while inclining them. This is undesirable from an efficiency standpoint, as already discussed.

As shown in FIG. 2, the image carrier unit A may be provided with a handle 68 to facilitate attachment and detachment of the unit A. Likewise, the developing unit B may be provided with a handle.

When the unit A is positioned on the frame 42, a part of the unit A protrudes downwardly through a slot 70 which is formed in the bottom of the frame 42 and, in addition, a gear 72 mounted on the shaft 18*a* protrudes downwardly through an opening 74 which is also formed in the bottom of the frame 42. The gear 72 then meshes with a gear, not shown, which is supported by the printer body 30. Further, the gear 72 meshes with a middle gear 76. Another middle gear 78 which is supported by the frame 42 is brought into mesh with a gear, not shown, which is installed in the developing unit B. Such a gearing serves to transmit the rotation of the gear in the printer body 30 to the drum 18, developing roller 50, supply roller 54, agitator 56 and others. In this manner, the gears associated with the respective units A and B are brought into and out of mesh with the gears associated with the frame 42 when the units A and B are mounted and dismounted. Because the units A and B are mounted and dismounted by lowering and raising them, the gears can be meshed with ease. Should the units A and B be slided horizontally during attachment and detachment, a substantial period of time would be required for the gears to be brought into mesh.

As described above, the units A and B can be replaced by easy manipulation. It is to be noted that the units A and B do not always have to be mounted or dismounted together since they are supported by the frame 42 independently of each other. Hence, when the drum 18 requires replacement due to deterioration, for example, the image carrier unit A alone can be removed with the developing unit B left on the frame 42 and without wasting the developing device 18 which withstands further use. In addition, in the case where a plurality of developing devices each containing a particular color of toner are prepared and selectively used, what is required is simply replacing the developing unit B only, eliminating the wasteful replacement of the image carrier unit A. that is, provision of developing units B each containing a particular color of toner suffices.

As shown in FIG. 2, the toner cartridge 58 of the unit B is provided with four lugs 80 while the reservoir 48 is provided with four engaging portions 82. The cartridge 58 is mounted to the reservoir 48 with the lugs 80 individually mated with the engaging portions 82. To supply a toner into the reservoir 48, the lugs 80 of the cartridge 58 are removed from the engaging portions 82 of the reservoir 48 and, then, the lugs 80 of a fresh cartridge 58 are mated with the engaging portions 82. As represented by a phantom line in FIG. 1, a seal 84 is adhered to a fresh cartridge 58 so as to hold a toner within the cartridge 58. When the seal 84 is pulled in a direction perpendicular to the sheet surface of FIG. 1, it is removed from the cartridge 58 to let the toner drop from the cartridge 58 into the reservoir 48. Again, because the developing device is supported horizontally by the frame 42, the toner supply can be accomplished with ease.

Figure 5:
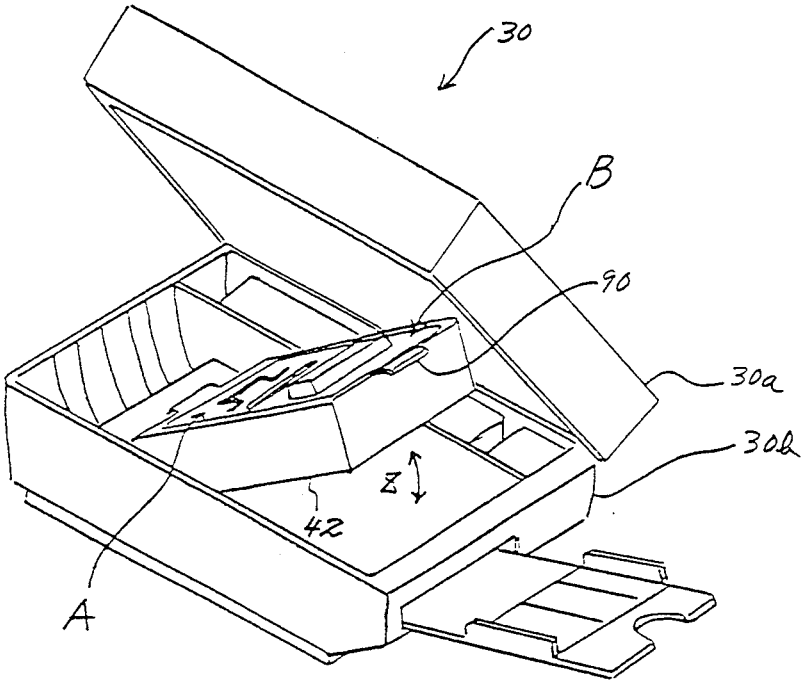
FIG. 5 is a perspective showing the laser printer with the upper part opened and the positioning frame rotated upwardly.

In this particular embodiment, the frame 42 is supported by the lower body part 30*b* in such a manner as to be rotatable up and down. Specifically, the frame 42 is provided with a recess 86 for engagement at the left end thereof as viewed in FIGS. 1 and 2. The recess 86 is engaged with a pin 88 which is studded on the lower body part 30*b*, whereby the frame 42 is rotatable about the pin 88. In this construction, when the upper body part 30*a* is opened as shown in FIG. 5, the frame 42 may be rotated about the pin 88 together with the units A and B as indicated by an arrow Z. This allows a paper jammed in a path below the frame 42 to be removed easily.

In a prior art imaging apparatus of the type described, it has been customary to remove a jammed paper by sliding forwardly a unit which includes a developing device and a photoconductive element. This is disadvantageous because when the unit is pulled out carelessly the jammed sheet is apt to rub on the photoconductive element and, thereby, scratch it. In contrast, the construction shown and described wherein the frame 42 is movable upwardly to raise the drum 18, a jammed paper is free from excessive forces otherwise applied thereto to damage the drum 18. Although the units A and B are constructed independently of each other, rotating the frame 42 causes the units A and B to move integrally therewith and, therefore, makes it needless to raise the units A and B one after another by troublesome operations. The frame 42 may be provided with a knob 90 to facilitate the rotation.

Preferably, the frame 42 is provided with a leg member 92 on the underside thereof to cause the frame 42 to be supported by the printer body 30 through the leg member 92, while that portion of the frame 42 which is remote from the leg member 92 is supported by a spring 94 which is mounted on the body 30. The spring 94 constantly biases the frame 42 upwardly in order to urge a pair of lugs 96 (FIG. 2) provided on, for example, the unit A against a part which belongs to the upper body part 30*a* or a frame thereof, e.g. a casing of the laser optics 22. This ensures accurate positioning of the drum 18 relative to the optics 22, thereby precluding defective images.

Figure 4:
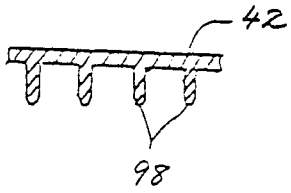
FIG. 4 is a section along IV—IV of FIG. 1.

As seen from FIG. 1, a paper moves along a path which is defined below the positioning frame 42. Taking it into account, a part of the frame 42 may be constructed to serve as a part of a guide adapted to guide the movement of a paper. In the illustrative embodiment, as shown in FIG. 4, the frame 18 is provided with a plurality of ribs 98 on the underside thereof to implement the paper guide. This eliminates the need for an independent guide member otherwise situated below the frame 42 to thereby reduce the number of parts, while promoting an immediate access to a jammed paper when the frame 42 is opened. Further, the frame 42 may be provided with a separator pawl 100 in a portion thereof which is close to the drum 18. The pawl 100 replaces an independent separator pawl heretofore used to separate a paper from the drum 18, whereby the number of structural elements is further cut down. Naturally, a separate pawl member may be mounted on the frame 42, if desired.

In summary, it will be seen that in accordance with the present invention an image carrier and a developing device can be readily mounted and dismounted while being held in a horizontal position. Because removal of a jammed sheet is accomplished by rotating a positioning frame upwardly together with the developing device and image carrier, the paper is prevented from scratching the image carrier. The developing unit and an image carrier unit are supported in such a manner as to be mounted to and dismounted from the frame independently of each other, eliminating wasteful replacement of parts which withstand further use. Further, defective images due to irregular developments and others are precluded since each of the units is positioned accurately by the frame.

Various modifications will become possible for those skilled in the art after receiving the teachings of the present disclosure without departing from the scope thereof. For example, the image carrier unit A may be constituted only by the drum 18 and members for supporting it or, conversely, extra parts may be added to the unit A. This is also true with the developing unit B; the gist is that the unit B includes at least the developing device.

It is to be noted that the present invention is applicable not only a laser printer as shown and described but also to other various kinds of imaging apparatus with or without the drum 18 replaced with a dielectric drum or a belt, for example.

What is claimed is:

1. An imaging apparatus developing a latent image formed on an image carrier to visualize the latent image comprising:

a lower housing constituting a part of a body of said apparatus;

an upper housing constituting another part of said body and openably by said lower housing;

a positioning frame member supported by said lower housing such that said frame member is rotatable to an upward and a downward position;

a developing unit including at least a developing device;

wherein said image carrier unit and said developing unit being supported by said positioning frame member and are separately detachable therefrom in both the upward and downward positions of said frame member.

2. An imaging apparatus as claimed in claim 1, wherein said developing unit further comprises a detachable toner cartridge.

3. An imaging apparatus as claimed in claim 1, wherein said positioning frame member constitutes a part of a guide member for guiding recording paper which is transported toward the image carrier.

4. An imaging apparatus as claimed in claim 1, wherein said positioning frame member comprises: a separator pawl which separates a recording paper from the image carrier.

5. An imaging apparatus as claimed in claim 1, wherein said image carrier unit comprises a cleaning device for cleaning the image carrier; a charging device; and a discharging device.

* * * * *